United States Patent [19]

Margulies

[11] Patent Number: 4,462,507

[45] Date of Patent: Jul. 31, 1984

[54] DISPENSING CLOSURE FOR CLOSING A CANISTER CONTAINING DISPENSABLE ARTICLES

[75] Inventor: Herman Margulies, South Orange, N.J.

[73] Assignee: Sterling Drug Inc., New York, N.Y.

[21] Appl. No.: 364,646

[22] Filed: Apr. 2, 1982

Related U.S. Application Data

[63] Continuation-in-part of Ser. No. 341,346, Jan. 21, 1982, abandoned, which is a continuation of Ser. No. 137,751, Apr. 7, 1980, abandoned, which is a continuation-in-part of Ser. No. 33,411, Apr. 26, 1979, abandoned.

[51] Int. Cl.[3] ..... A47K 10/24

[52] U.S. Cl. ..... 221/63; 206/409

[58] Field of Search ..... 221/63, 302; 222/541, 222/543, 502, 480; 206/205, 210, 409; 225/106; 220/339, 375, 254

[56] References Cited

U.S. PATENT DOCUMENTS

| | | | |
|---|---|---|---|
| 2,343,064 | 2/1944 | Kjorsvik . | |
| 3,217,949 | 11/1965 | Davis | 222/541 X |
| 3,269,617 | 8/1966 | Goth | 222/541 |
| 3,310,353 | 3/1967 | Cordis | 206/205 X |
| 3,458,080 | 7/1969 | Laurizio . | |
| 3,484,016 | 12/1969 | Turner . | |
| 3,486,665 | 12/1969 | La Croce . | |
| 3,495,746 | 2/1970 | Laurizio . | |
| 3,749,296 | 7/1973 | Harrison . | |
| 3,784,055 | 1/1974 | Anderson . | |
| 3,836,056 | 9/1974 | Pehr | 222/480 |
| 3,841,466 | 10/1974 | Hoffman et al. . | |
| 3,843,017 | 10/1974 | Harrison . | |
| 3,845,872 | 11/1974 | Towns et al. . | |
| 3,868,052 | 2/1975 | Rockefeller . | |
| 3,881,639 | 5/1975 | Herip . | |
| 3,899,285 | 8/1975 | Christmas . | |
| 3,908,857 | 9/1975 | Chiappe . | |
| 3,967,756 | 7/1976 | Barish . | |
| 3,973,695 | 8/1976 | Ames | 221/63 |
| 3,982,659 | 9/1976 | Ross . | |
| 3,986,479 | 10/1976 | Bonk . | |
| 3,990,603 | 11/1976 | Brochman . | |
| 3,994,417 | 11/1976 | Boedecker . | |
| 4,017,002 | 4/1977 | Doyle et al. . | |
| 4,047,495 | 9/1977 | O'Brian . | |
| 4,185,754 | 1/1980 | Julius | 221/63 |

FOREIGN PATENT DOCUMENTS

| | | | |
|---|---|---|---|
| 2750281 | 5/1979 | Fed. Rep. of Germany | 221/63 |

*Primary Examiner*—F. J. Bartuska

*Attorney, Agent, or Firm*—Wenderoth, Lind & Ponack

[57] ABSTRACT

A dispensing closure for closing an end of a canister containing dispensable articles includes a top adapted to fit over an open end of a canister. The top has depending therefrom an integral peripheral axial flange. The top has therein a dispensing opening and a slit connected with the dispensing opening. The closure may be originally provided with the dispensing opening, or alternatively the closure may be originally provided with a tear-out member which is removed by the consumer to form the dispensing opening. The dispensing opening and slit may be formed directly in the top, or alternatively the top may have a recess defined by a bottom wall and a side wall, with the dispensing opening and slit being formed in the bottom wall of the recess. A lid is selectively movable between a first position covering the top or fitted within the recess and a second position removed from the top or recess. The lid includes a first portion adapted to cover the tear-out member or the dispensing opening when the lid is in the first position thereof. The lid includes a second portion adapted to cover the slit when the lid is in the first position thereof. The second portion of the lid is integrally but flexibly connected to the first portion of the lid, such that when the lid is in the first position therof the second portion of the lid is selectively pivotable with respect to the first portion of the lid away from the top, thereby to uncover the slit.

66 Claims, 41 Drawing Figures

DISPENSING CLOSURE FOR CLOSING A CANISTER CONTAINING DISPENSABLE ARTICLES

This application is a continuation-in-part of application Ser. No. 341,346, filed Jan. 21, 1982, now abandoned, which is a continuation of application Ser. No. 137,751, filed Apr. 7, 1980, now abandoned, which is a continuation-in-part of application Ser. No. 33,411, filed Apr. 26, 1979, now abandoned.

BACKGROUND OF THE INVENTION

The present invention relates to a dispensing closure for closing an end of a container or canister containing dispensable articles.

More particularly, the present invention relates to such a dispensing closure for closing a canister containing towels or tissues, e.g. towels or tissues which are joined by interlocking, or which are in the form of a continuous web with individual towels being separably connected by perforations.

There have been developed a great many types of dispensing units for dispensing towels and tissues. However, the dispensing of a web of towels which are separably connected by perforations presents particularly difficult dispensing problems, especially when the web of towels is a web of pre-moistened washcloth-type towels. Most prior art units for dispensing this type of product present inconveniences in use. More particularly, in such a dispensing unit, it is necessary to maintain some degree of airtightness of the dispensing unit to avoid drying out of the pe-moistened towels. This inherently leads to restriction of the size of the dispensing opening of the unit. If the continuity of dispensing of the towels is interrupted, then the dispensing unit must be completely opened to again thread or insert a towel through the dispensing opening. Furthermore, when initially commencing use of such prior art units, it is normally necessary to open the entire unit to insert the first towel through the dispensing opening. All of these problems result in inconvenience to the consumer and/or additional cost to the manufacturer or assembler.

One prior art attempt to overcome such disadvantages is shown in Ames U.S. Pat. No. 3,973,695, wherein there is shown a dispensing cap having a dispensing opening including an enlarged portion, a slot or groove connected at one end thereof to the enlarged portion, and a circular end portion connected to the other end of the slot. The entire dispensing opening is selectively covered by a lid which is hinged to the cap. Individual towels connected to other towels of a web by perforations are dispensed from a container or canister by threading the web of towels through the enlarged portion, and then pulling the towel outwardly through the slot and substantially into the circular portion. The slot and circular portion impart tension to a leading towel such that it is separated from a succeeding towel along the perforations, with the succeeding towel then partially extending through the slot and circular opening.

However, this dispensing arrangement of Ames still has certain inherent disadvantages. More particularly, the enlarged portion of the dispensing opening is oftentimes not large enough to enable the first towel to be dispensed to be manually pulled through the enlarged portion at commencement of use of the device. This necessitates removal of the entire cap to thread the first towel through the dispensing opening. This disadvantage also occurs if the continuity of the dispensing operation is interrupted by a towel being separated from the web of towels without the succeeding towel at least partially extending through the dispensing opening. Furthermore, in the arrangement of Ames, the towels cannot be dispensed without lifting the lid and exposing the entire dispensing opening. This inherently subjects the towels within the container to the surrounding atmosphere, and if the towels are pemoistened towels, then the towels will dry out more rapidly than is desirable. Similarly, before the canister or container of towels is used by a consumer, for example when the canister of towels is stored in a warehouse or store prior to purchase by the consumer, premoistened towels will tend to dry out unless the lid is tightly sealed over the dispensing opening. In practice it is quite difficult to achieve such tight sealing, and when sufficiently tight sealing is achieved the manufacturing cost of the unit is substantially increased.

SUMMARY OF THE INVENTION

With the above discussion in mind, it is the primary object of the present invention to provide a dispensing closure for closing a container or canister containing dispensable articles, which dispensing closure overcomes the above discussed and other disadvantages of prior art arrangements.

It is a further object of the present invention to provide such a dispensing closure which is particularly useful for closing an end of a container or canister containing towels which are joined by interlocking or which are in the form of a continuous web of towels which are separably connected by perforations.

It is a yet further object of the present invention to provide such a dispensing closure for dispensing such towels which are in the form of premoistened towels such as washcloth-type towels.

It is a still further object of the present invention to provide such a dispensing closure whereby it is possible to substantially completely isolate the interior of the container or canister from the surrounding atmosphere prior to purchase and use by a consumer.

It is an even further object of the present invention to provide such a dispensing closure whereby it is possible to thread the first towel through the dispensing opening and to thereafter re-thread a towel through the dispensing opening if such threading is interrupted, without the necessity of removing the dispensing closure from the canister or container containing the towels.

It is a yet further object of the present invention to provide such a dispensing closure whereby it is possible to maintain the interior of the container or canister substantially isolated from the surrounding atmosphere even when towels are being dispensed.

The above objects are achieved in accordance with the present invention by the provision of a dispensing closure for closing an end of a container or canister containing dispensable articles, the closure including a top adapted to fit over an open end of a canister, the top having depending therefrom an integral peripheral axial flange adapted to fit the closure on a canister. The top has therein a dispensing opening and a slit which connects with and opens into the dispensing opening. A lid is selectively movable between a first position covering at least a portion of the top to close and seal the dispensing opening and slit and a second position removed from the top to provide access by a consumer to the dispensing opening and slit. The lid may preferably be integrally hinged to the flange. The lid includes a first portion which is adapted to cover the tear-out member or the dispensing opening when the lid is in the first or closed position thereof. The lid also includes a second portion adapted to cover the slit when the lid is in the first or closed position thereof. The second portion of the lid is integrally but flexibly connected to the first portion of the lid, such that when the lid is in the first or closed position thereof, the second portion of the lid may be selectively pivoted with respect to the first portion of the lid away from the top, to thereby uncover the slit, thereby allowing dispensing of towels through the slit even when the first portion of the lid covers the dispensing opening.

In accordance with one arrangement of the invention the top has therein a recess defined by a bottom wall and a side wall. The dispensing opening and slit are formed in the bottom wall of the recess. The closure may be produced originally with the slit and dispensing opening provided therein. Alternatively, a portion only of the bottom wall may be defined by an integral removal tear-out member which may be removed when a consumer desires to commence use of the unit. Removal of the tear-out member forms the dispensing opening in the bottom wall. Before the dispensing closure is initially used, the slit is closed, either by an extension of the tear-out member, or by an integral thin membrane of the material of the closure, which membrane is easily rupturable after removal of the tear-out member, thereby insuring sealing integrity of the closure prior to initial use.

In accordance with an advantgeous feature of the present invention, the entire closure, including the top, the flange, the recess, the tear-out member and the first and second portions of the lid are formed as an integral single member, preferably a molded plastic element.

The dispensing closure of the present invention is particularly useful to close a canister containing a web, e.g. a roll of towels which are separately connected by perforations, particularly such a web of premoistened towels of the washcloth type. The dimension of the tear-out member is such that upon removal thereof the dispensing opening has a size sufficient to enable fingers of a consumer to extend through the dispensing opening to grasp a first towel of the web of towels, to pull such first towel partially upwardly through the dispening opening and then toward and into the slit, thereby allowing prethreading of the towels through the dispensing opening and slit without the necessity of removing the closure from the canister. The slit has a size and shape such that, upon pulling a towel outwardly of the canister through the slit, the side edges of the slit apply sufficient tension on the towel being pulled through the slit to allow separation of such towel from a succeeding towel of the web of towels, whereby such succeeding towel will then be partially extended through the slit for subsequent dispensing.

In accordance with a further feature of the present invention the tear-out member is integrally but removably formed with the bottom wall of the recess along reduced thickness potions such as score lines. Further preferably, the tear-out member is integrally formed with the bottom wall of the recess in a plane which is beneath the plane of the bottom wall. This forms a depression between the outer surfaces of the tear-out member and the bottom wall and facilitates the molding operation. Furthermore, the tear-out member is integrally formed with an outwardly extending flexible tab, for example a ring-shaped tab, to facilitate removal of the tear-out member. The tab has a size sufficient to be folded and received between the tear-out member and the first portion of the lid when the lid is in the first or closed position thereof.

In accordance with a further feature of the present invention, the tear-out member has a configuration such that upon removal of the tear-out member the dispensing opening will include edges which converge toward and join side edges of the slit. A particularly advantageous configuration of the dispensing opening is a teardrop-shaped configuration.

The slit includes a first end which joins and opens into the dispensing opening and a second end which extends away from and is spaced from the dispensing opening. The second end of the slit may have various configurations to provide particularly advantageous tension characteristics for dispensing particular types of towels. Further, the bottom wall of the recess may have an integral upwardly extending bead positioned at the second end of the slit to reinforce the material, for example flexible plastic material, adjacent the dispensing second end of the slit and to aid in separation of the towel being dispensed. The axial flange extending from the top of the dispensing closure may include an outwardly extending reinforcing flange, an inwardly extending bead or rib adapted to engage with an outer lip or rib of the canister for attachment and/or sealing of the dispensing closure to the canister. Further, the top may have extending axially therefrom a projection, positioned coaxially inwardly of the flange, for sealing engagement with the canister, thereby providing a substantially leakproof seal with the canister.

In accordance with a further optional feature of the invention, the upper surface of the top of the closure may include an integral stacking rib to facilitate stacking of a plurality of the canisters.

In accordance with a yet further feature of the present invention the lid may be integrally joined with and connected to the flange by a flexible elongated connecting hinge. Further, the top of the closure may have a recessed groove portion extending from the periphery of the top to the recess therein, such that when the lid is in the first or closed position thereof, a portion of the hinge fits into and is accommodated within the recessed groove portion.

In accordance with one embodiment of the lid of the present invention, the second portion of the lid is integrally connected to the first portion of the lid by a reduced thickness portion of the lid. Such reduced thickness portion extends transversely in the form of a chord, such that the first and second portions of the lid are in the form of circular segments.

In accordance with a second embodiment of the lid of the invention, the lid has therein a pair of slits which extend from respective first ends at the periphery of the lid to respective second ends spaced inwardly from the periphery of the lid. The pair of slits converge from the respective first ends thereof to the respective second ends thereof. That portion of the lid which is between the pair of slits comprises the second portion of the lid, and such second portion of the lid is integrally connected to the first portion of the lid by a reduced thickness portion extending between the second ends of the pair of slits.

Further flexibility of the second portion of the lid, in both of the above embodiments, may be provided in that the inner surface of the second portion of the lid may have a second reduced thickness portion which extends substantially parallel to the first reduced thickness portion which connects the second portion of the lid to the first portion of the lid.

In accordance with an even further feature of the present invention, the lid and the recess are formed with locking means for locking the lid in the first or closed position, thereby effectively sealing the slit and dispensing opening from the surrounding atmosphere.

When the second portion of the lid has therein the second reduced thickness portion as discussed above, then the locking means and both of the reduced thickness portions have dimensions and flexibility such that, when the lid is in the first or closed position thereof, manual pressure on the second reduced thickness portion will cause the area between the two reduced thickness portions to depress, thereby causing that part of the second portion which is outwardly of the second reduced thickness portion to rise up out of the recess, and thereby cause the second portion of the lid to pivot with respect to the first portion of the lid outwardly of the recess, while the first portion of the lid will remain locked in the recess by the locking means.

In a particularly advantageous arrangement of the invention, the locking means includes a substantially annular bead in the side wall of the recess and a complementary substantially annular groove in the lid. Alternatively, the bead could be provided in the lid, and the complementary groove could be provided in the side wall of the recess.

In accordance with a still further feature of the present invention, the first portion of the lid includes an integral peripheral flange extending therefrom. The flange is dimensioned to press against the bottom wall of the recess when the lid is in the first or closed position thereof. This provides further sealing and isolation of the dispensing opening from the surrounding environment.

Similarly, the second portion of the lid may have extending therefrom an integral flange portion adapted to abut against the bottom wall of the recess when the lid is in the first or closed position thereof. Alternatively, the recess may have therein integral peripheral rests positioned to be abutted by the second portion of the lid or an integral flange portion thereof.

In accordance with a still further feature of the present invention, the top and the side wall of the recess may have therein an indented area at a position adjacent an edge of the lid, and particularly the second portion of the lid, when the lid is in the first or closed position thereof. The second portion of the lid may have extending outwardly therefrom a tab which is adapted to fit within the indented area. This arrangement facilitates manual movement of the lid from the first or closed position thereof to the second or open position thereof, and also facilitates manual movement of the second portion of the lid, with respect to the first portion of the lid, outwardly of the recess, while the first portion of the lid remains locked in the recess.

In accordance with a still further feature of the present invention, the tear-out member is integrally but removably formed with the bottom wall along a first reduced thickness area, and the tear-out member includes a starter portion formed integrally with the remainder of the tear-out member along a second reduced thickness area. A part of the periphery of the starter portion is defined by a part of the first reduced thickness area, such that downward pressure on the starter portion will rupture the part of the first reduced thickness area which defines a part of the starter portion and cause the starter portion to pivot downwardly about the second reduced thickness area. Thereby, the starter portion may then be gripped and pulled upwardly to achieve removal of the remainder of the tear-out member along the remainder of the first reduced thickness area. Preferably, the second reduced thickness area extends linearly between the spaced portions of the first reduced thickness area. The part of the first reduced thickness area which defines a part of the periphery of the starter portion may be of a first thickness, and the remainder of the first reduced thickness area is of a second thickness greater than the first thickness. In accordance with a further preferred feature of this arrangement, the first reduced thickness area is of a uniform thickness throughout the entire periphery of the tear-out member. Even further, prior to removal of the tear-out member, the slit is closed by an integral thin membrane which is of the same thickness as the first reduced thickness area.

In accordance with an alternative arrangement of this feature of the present invention, the second reduced thickness area includes a first part having a first thickness and a second part having a second thickness greater than the first thickness. Thereby, downward pressure on the starter portion will rupture the first part of the second reduced thickness area and that part of the first reduced thickness area which partially defines the periphery of the starter portion and cause the starter portion to pivot downwardly about the second part of the second reduced thickness area. Thus, the starter portion may then be gripped and pulled upwardly to achieve removal of the remainder of the tear-out member along the remainder of the first reduced thickness area. Preferably, that part of the first reduced thickness area which partially defines the perimeter of the starter portion is of the first thickness. Further preferably, a first portion or portions of the remainder of the first reduced thickness area adjacent at least the second part of the second reduced thickness area, or alternatively adjacent both parts of the second reduced thickness area, are of the first thickness, and a second portion of the remainder of the first reduced thickness area is of the second thickness. Prior to the removal of the tear-out member, the slit may be closed by an integral thin membrane which is of the first thickness.

In accordance with a further feature of this arrangement of the present invention, there may be provided a substantially annular projection extending from the bottom wall of the recess at a position spaced inwardly of the side wall of the recess to define therewith a substantially annular groove. Peripheral flange portions extend from the first and second portions of the lid. The annular projection and the peripheral flange portions have configurations, for example complementarily inclined surfaces, such that the peripheral flange portions snap into the annular groove when the lid is in the first position, thereby removably locking the lid in the recess.

Additionally, the bottom wall may have extending therefrom a pair of angular projections, for example substantially L-shaped projections, positioned on opposite sides of the slit. A space or groove separates the two angular projections in the area of the juncture of the slit and the dispensing opening or tear-out member. The first portion of the lid has extending therefrom a projection shaped and dimensioned to contact the angular projections when the first portion of the lid is in the first position thereof. This insures sealing of the dispensing opening when the first portion of the lid is in the first position and the second portion of the lid is pivoted away from the recess to uncover the slit during a dispensing operation.

In accordance with another arrangement of the present invention, the closure top is not provided with a recess, but includes a projection extending from the top at a position adjacent the periphery thereof. The first and second portions of the lid have extending therefrom peripheral flange portions shaped and dimensioned, for example by complimentary inclined surfaces, to snap over the projection on the closure top, thereby removably locking the first and second portions of the lid on the top. The top may have transverse projections located on opposite sides of the slit. Such transverse projections may be separated by a space or groove at the area of the juncture of the slit and the dispensing opening. A transverse projection extends from the first portion of the lid at a location adjacent the second portion of the lid to contact the transverse projections on the top when the first portion of the lid is in the first position thereof. Thereby, when the lid is in the first position thereof, the transverse projection on the first portion of the lid creates a seal with the transverse projections on the top when the second portion of the lid is pivoted away from the top during a dispensing operation. In this arrangement of the present invention, the closure may be originally formed with the slit and the dispensing opening, or alternatively the closure may be originally provided with a tear-out member similar to those discussed above, whereby upon removal of the tear-out member by a consumer the dispensing opening is formed. In a modification of this arrangement of the present invention, a forward end of the top may have therein a slot, at a position spaced from the dispensing opening. A second portion of the lid may have extending therefrom a tab dimensioned to snap into the slot, thereby removably locking the lid in the first position. The slot and tab are dimensioned to achieve such locking, for example by providing that the slot is wider at the bottom thereof than the top thereof, and by providing that the tab is wider at the outer portion thereof than at the inner portion thereof.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

With reference now to FIGS. 1 through 5 of the drawings, an embodiment of the dispensing closure of the present invention will be described in detail.

Figure 5:
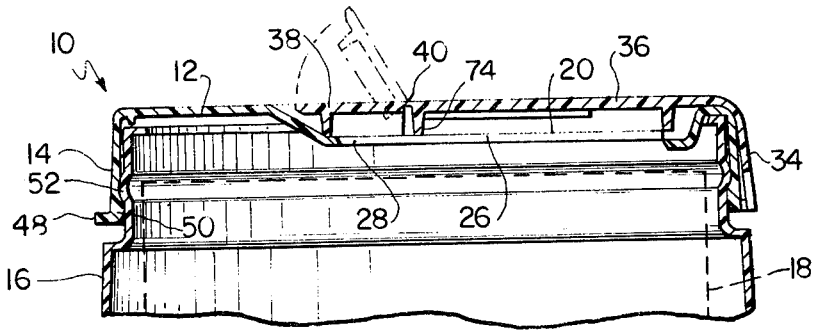
FIG. 5 is a cross-sectional view similar to FIG. 4, but showing the dispensing closure with the tear-out member thereof removed.

The dispensing closure, generally designated by the reference numeral 10, includes a top 12 having depending therefrom an integral peripheral axial flange 14 adapted to position the top 12 on a container or canister 16 which is adapted to contain towels, for example a web of premoistened washcloth-type towels, shown schematically only in FIG. 5 at 18. The top 12 has in the upper surface thereof a recess defined by a bottom wall 20 and a side wall 22 joining bottom wall 20 to top 12.

A portion of bottom wall 20 may be defined by an integral removable tear-out member 24, such that upon removal of tear-out member 24, there is formed a dispensing opening 26 in bottom wall 20. The dispensing opening 26 is particularly shown in FIGS. 5 and 31 of the drawings. The bottom wall 20 has formed therein a slit 28 which, when the tear-out member 24 is removed, connects with and opens into the dispensing opening 26. When the closure 10 is formed, the slit 28 is initially closed, either by an extension (not shown) of the tear-out member 24, or by an integral thin membrane 29 of the material of the closure. Such membrane is easily ruptured after removal of the tear-out member 24, thereby opening the slit 28. The tear-out member 24 is integrally formed with the remainder of the closure element, for example by means of reduced thickness portions 30.

Figure 1:
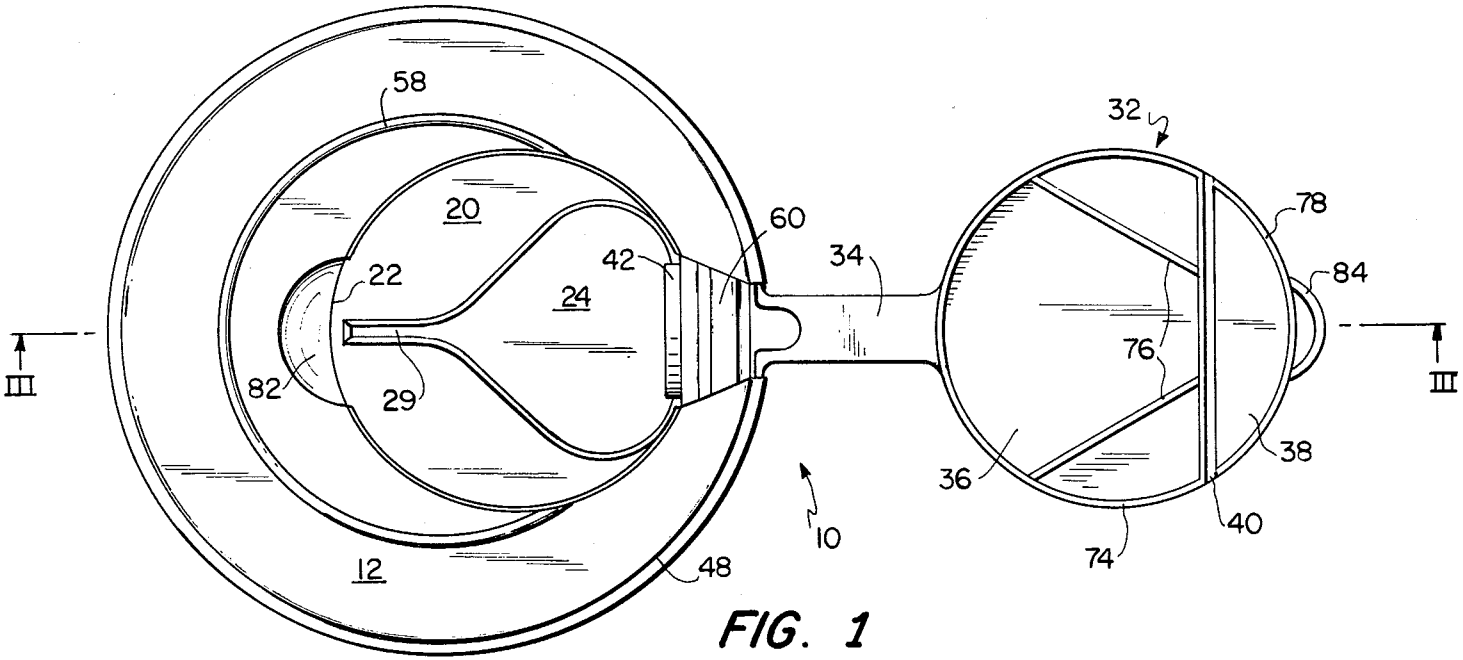
FIG. 1 is a plan view of a dispensing closure according to the present invention, with the lid thereof being shown in an open position.
Figure 2:
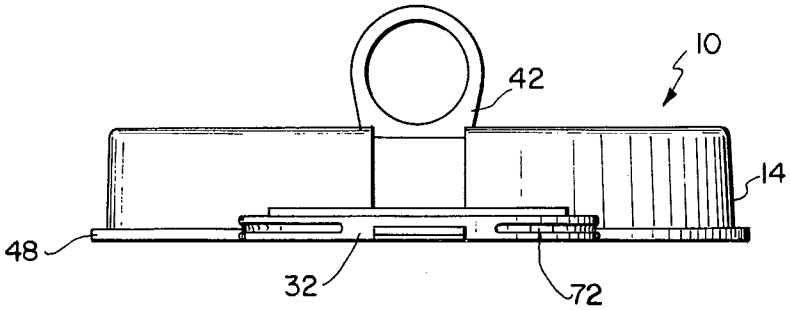
FIG. 2 is a side elevation view of the dispensing closure, as viewed from the right side of FIG. 1.
Figure 3:
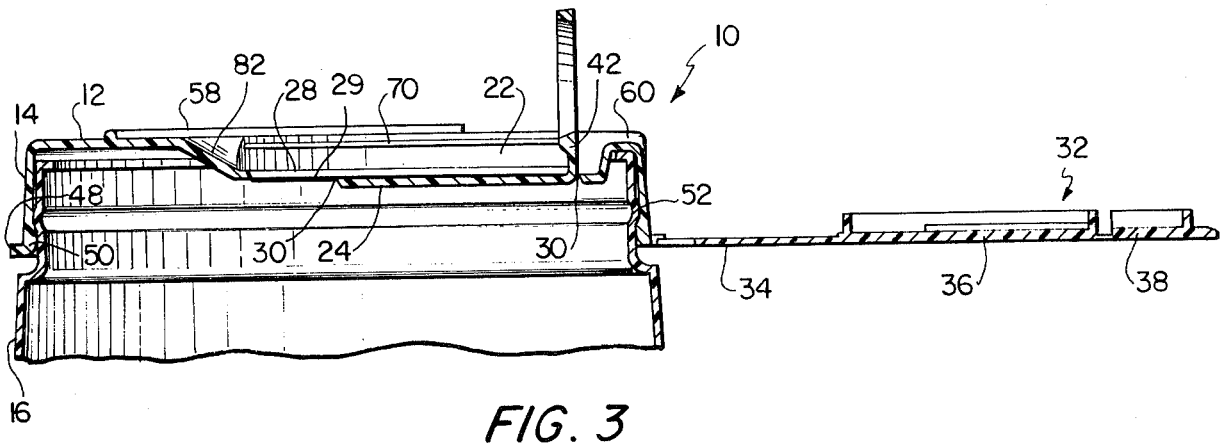
FIG. 3 is a cross-sectional view taken along line III—III of FIG. 1, and additionally showing the manner of attachment of the dispensing closure to a container or canister adapted to contain a roll of towels.
Figure 4:
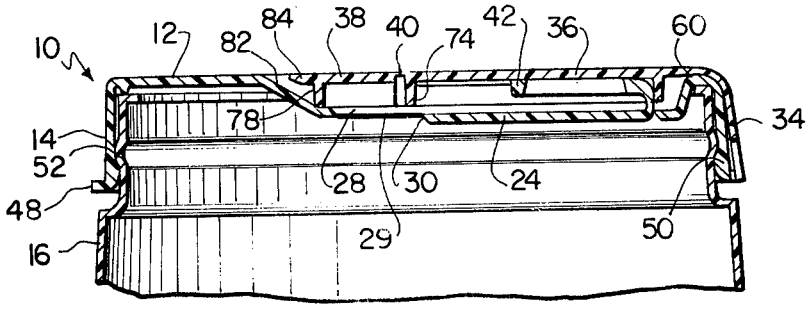
FIG. 4 is a cross-sectional view similar to FIG. 3, but showing the lid moved to a closed position thereof, and with the tear-out member thereof still in place.

A lid 32 is selectively movable between a first or closed position fitting within the recess in top 12, as shown in FIGS. 4 and 5, and a second or open position wherein the lid 32 is removed from the recess, as shown in FIGS. 1, 2 and 3. Lid 32 may be integrally hingedly connected to flange 14 by means of elongated flexible hinge 34. The lid 32 includes a first portion 36 and a second portion 38. First lid portion 36 is adapted to cover the tear-out member 24 (FIG. 4) or the dispensing opening 26 (FIG. 5) when the lid 32 is in the first or closed position thereof. The second portion 38 is adapted to cover slit 28 when the lid 32 is in the first or closed position thereof, as shown in FIGS. 4 and 5. Second portion 38 is integrally but flexibly and hingedly connected, as at a reduced thickness portion 40, to first portion 36 of the lid, such that when the lid is in the first or closed position thereof the second portion 38 of the lid is selectively pivotable from the closed position, shown in solid lines in FIG. 5, to an open-flap position out of the recess, to thereby uncover the slit 28, as shown in the dashed lines in FIG. 5.

In accordance with an advantageous feature of the present invention, the entire closure 10, including top 12, flange 14, bottom wall 20, side wall 22, tear-out member 24, hinge 34, and lid 32, is formed as an integral single closure member, preferably such as a molded plastic element.

Preferably the tear-out member 24 has a dimension such that upon removal of tear-out member 24 the dispensing opening 26 has a size sufficient to enable the fingers of a consumer to extend through dispensing opening 26 to grasp a first towel of the web of towels 18. This first towel is pulled outwardly of dispensing opening 26 and is then pulled laterally, i.e. to the left side of FIGS. 1 and 3 through 5, into slit 28. It will be understood that slit 28 has a size and shape such that, upon pulling a towel outwardly of the canister through slit 28, side edges of slit 28 apply sufficient tension on the towel being pulled through the slit to allow separation of such towel from a succeeding towel of the web of towels 18, whereby such succeeding towel will then be partially extended through slit 28. Thus, the side edges of slit 28, as well as the end of the slit spaced from the dispensing opening 26 (to be discussed in more detail below) apply sufficient tension to allow automatic separation of a given towel from the succeeding towel, along the perforations therebetween, while ensuring that such succeeding towel will automatically be threaded through the slit 28. Preferably, automatic separation occurs with only a relatively small tip portion of the succeeding towel extending through the slit.

As shown particularly in FIGS. 3 and 4, the tear-out member 24 is integrally but removably formed with the bottom wall 20 by the above discussed reduced thickness score lines 30, such that the plane of tear-out member 24 extends beneath a plane of bottom wall 20. There is thereby formed a depression between the upper and outer surfaces of tear-out member 24 and the bottom wall 20. This facilitates the molding of the closure as a single integral member. The tear-out member 24 has integrally formed therewith a flexible tab 42, for example a ring-shaped tab as shown in the drawings. Tab 42 extends outwardly from tear-out member 24 and facilitates removal of tear-out member 24. Tab 42 has a size to fit between the tear-out member 24 and first portion 36 of lid 32 when the lid is in the first or closed position thereof, as shown in FIG. 4.

An important feature of this arrangement of the present invention is the overall configural arrangement wherein the recess is formed in a portion of the top 12, wherein the recess may be wholly or partially selectively covered by the lid 32, and wherein the dispensing opening 26 and slit 28 are entirely provided in the bottom wall 20 of the recess, with the tear-out member 24 forming only a portion of the area of bottom wall 20.

In accordance with a further preferred feature of the present invention, the tear-out member 24 has a configuration such that upon removal of the tear-out member 24 the dispensing opening 26 will have edges which converge toward and join with side edges of slit 28. A particularly desirable configuration of the dispensing opening 26 is the teardrop-shaped configuration shown in the drawings.

As indicated above, the end of the slit 28 which is spaced away from dispensing opening 26 aids in applying tension to the towels during dispensing thereof. This outer end of slit 28 may be provided with various configural arrangements to provide more or less tension, as desired for a particular operation. Slit 28 is entirely linear with a transverse outer end in the arrangement shown in FIGS. 1 through 5 of the drawings. However, this outer end of the slit 28 may have various other configural arrangements designed to impart varying degrees of tension during the towel dispensing and separating operation. Examples of such configural arrangements are shown in FIGS. 8 through 29.

Figure 8:
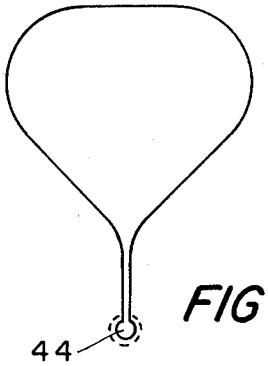
FIGS. 8 through 29 are schematic views illustrating various configurations of the dispensing opening and connecting slit in accordance with the present invention.
Figure 9:
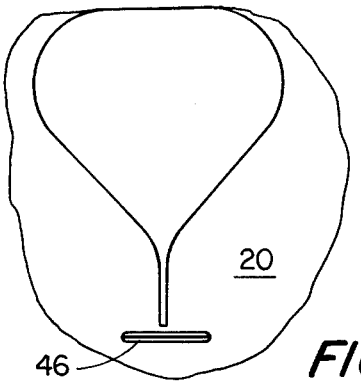
Figure 10:
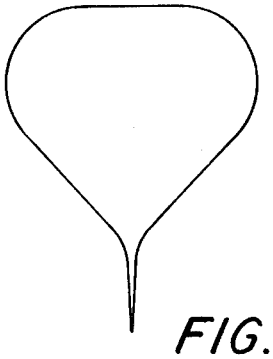
Figure 11:
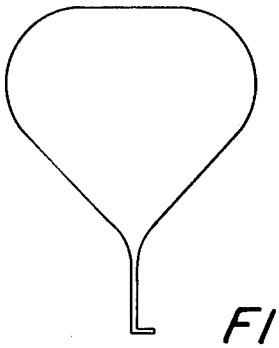
Figure 12:
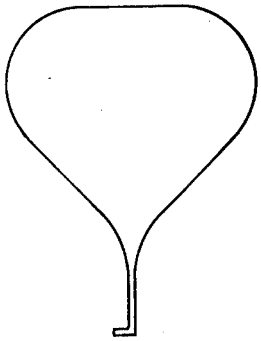
Figure 13:
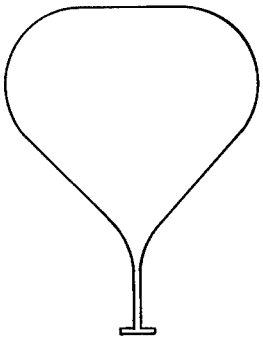
Figure 14:
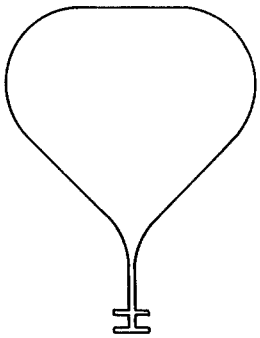
Figure 15:
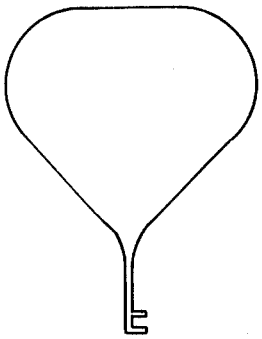
Figure 16:
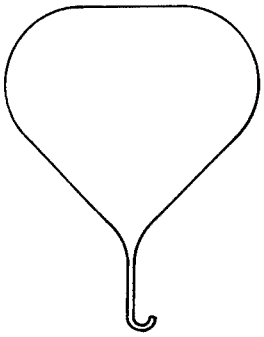
Figure 17:
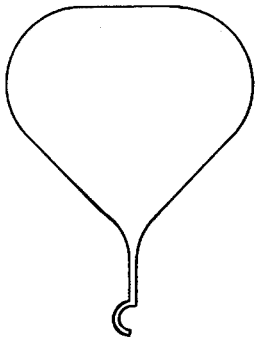
Figure 18:
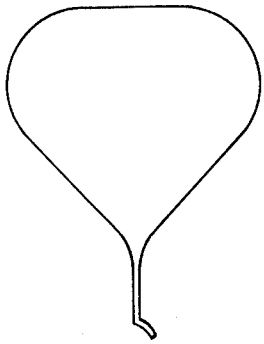
Figure 19:
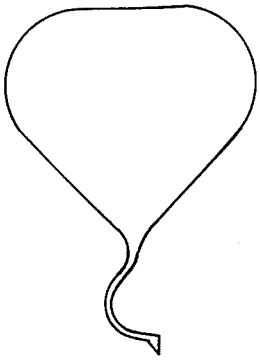
Figure 20:
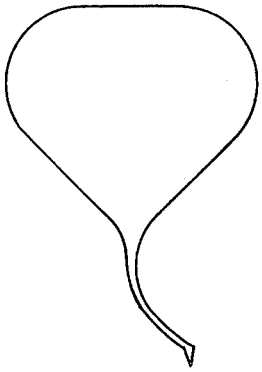
Figure 21:
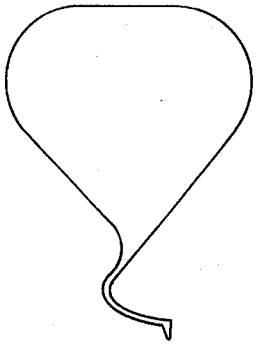
Figure 22:
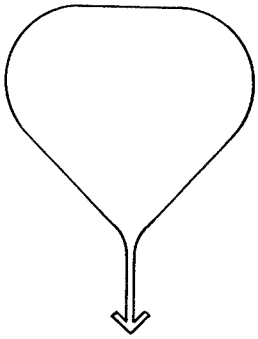
Figure 23:
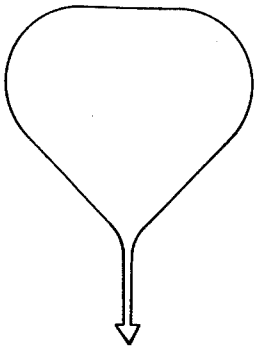
Figure 24:
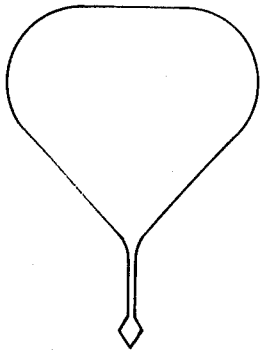
Figure 25:
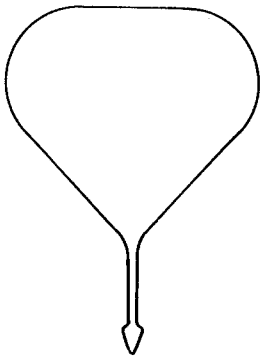
Figure 26:
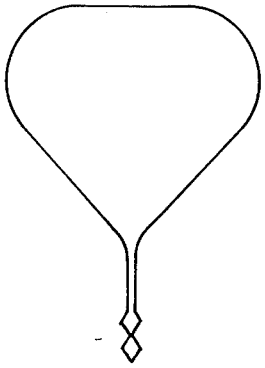
Figure 27:
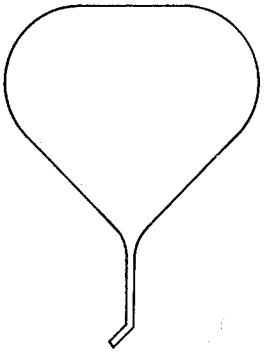
Figure 28:
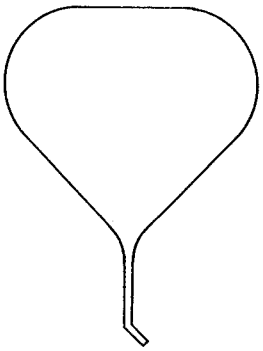
Figure 29:
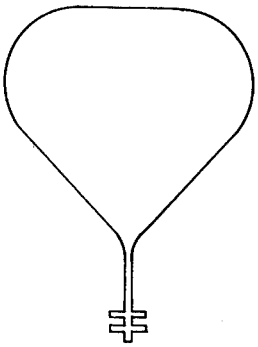

More particularly, in FIG. 8, there is provided a circular opening through the bottom wall 20, the circular opening being connected with the outer end of slit 28. This opening 44 is conical and is shown in more detail in FIG. 30. In FIG. 9, there is shown an arrangement whereby bottom wall 20 has extending upwardly therefrom an integral bead 46 positioned to extend transversely across the outer end of slit 28. Bead 46 thus strengthens the flexible plastic material of the bottom wall 20 adjacent the dispensing end of the slit, and can further affect the dispensing tension of the outer end of the slit. As shown in FIG. 10, the slit may be formed by side edges converging from the dispensing opening to a point at the second outer end of the slit. As shown in FIGS. 11 and 12, the outer end of the slit 28 may be L-shaped. As shown in FIG. 13, the outer end of the slit may be T-shaped. As shown in FIG. 14, the outer end of the slit may be H-shaped. The outer end of the slit may also be F-shaped, as shown in FIG. 15. Also, the outer end of the slit 28 may have various hook-shaped configurations as shown in FIGS. 16 through 21. Even further, the outer end of the slit 28 may be arrow-shaped as shown in FIGS. 22 and 23. The outer end of the slit 28 may be diamond-shaped, as shown in FIG. 24, or teardrop-shaped, as shown in FIG. 25. Still further, the outer end of the slit 28 may have a double-diamond configuration, as shown in FIG. 26. Yet further, the outer end of the slit may extend at an angle inclined with respect to the remainder of the slit, as shown in FIGS. 27 and 28. Additionally, the second end of the slit 28 may be shaped like a cross with two cross bars as shown in FIG. 29.

It is specifically to be understood that the outer end configurations of slit 28 as shown in FIGS. 8 through 29 are intended to be exemplary of preferred embodiments of the present invention. It should however be appreciated that other configurations are possible within the scope of the present invention.

The free axial end of flange 14 includes a radially outwardly extending annular flange 48 which helps to strengthen flange 14. As shown in FIGS. 3 through 5, the axial flange 14 may include an integral radially inwardly extending annular bead 50 adapted to cooperate with an outer annular bead 52 on the canister 16, to thereby attach the closure 10 to the canister 16.

However, with reference to FIG. 30 of the drawings, an alternative manner of attachment of the closure 10 to the canister 16 will be described. In this arrangement the axial flange 14 includes an integral radially inwardly extending annular projection 54 forming a lip adapted to cooperate with an outer annular lip 56 on the canister 16, thereby allowing the closure 10 to be locked onto the canister 16. Furthermore, the top 12 has depending therefrom an axially extending annular bead 57, at a position coaxially inwardly of axial flange 14, for cooperation with an inner surface of the canister 16 to form a leakproof seal therewith.

In accordance with a further feature of the present invention, the upper surface of the top 12 may be provided with an integral stacking rib 58 (shown only in FIGS. 1, 3 and 31 for purposes of clarity) to facilitate stacking of plural canisters equipped with the dispensing closure of the invention.

Figure 30:
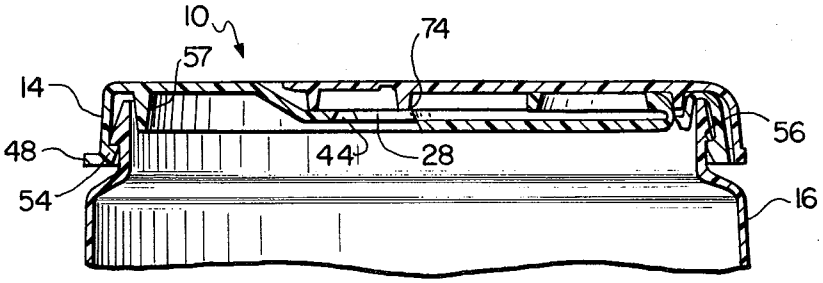
FIG. 30 is a cross-sectional view similar to FIG. 4, but illustrating certain modifications of the dispensing closure.

In accordance with a further feature of the present invention, the top 12 has formed therein a recessed groove portion 60 extending from the periphery of the top to the recess at a position such that when the lid 32 is in the first or closed position thereof, such as shown in FIGS. 4, 5 and 30, the hinge 34 fits into and is accommodated within recessed groove portion 60.

As shown in FIG. 1, the second portion 38 of lid 32 is integrally connected to first portion 36 of the lid by a reduced thickness portion 40. In the embodiment of FIG. 1, the reduced thickness portion 40 is in the form of a chord of the circle of lid 32, such that the first and second portions 36 and 38 of the lid are in the form of circular segments. This is clearly shown in FIG. 1 of the drawings.

Figure 31:
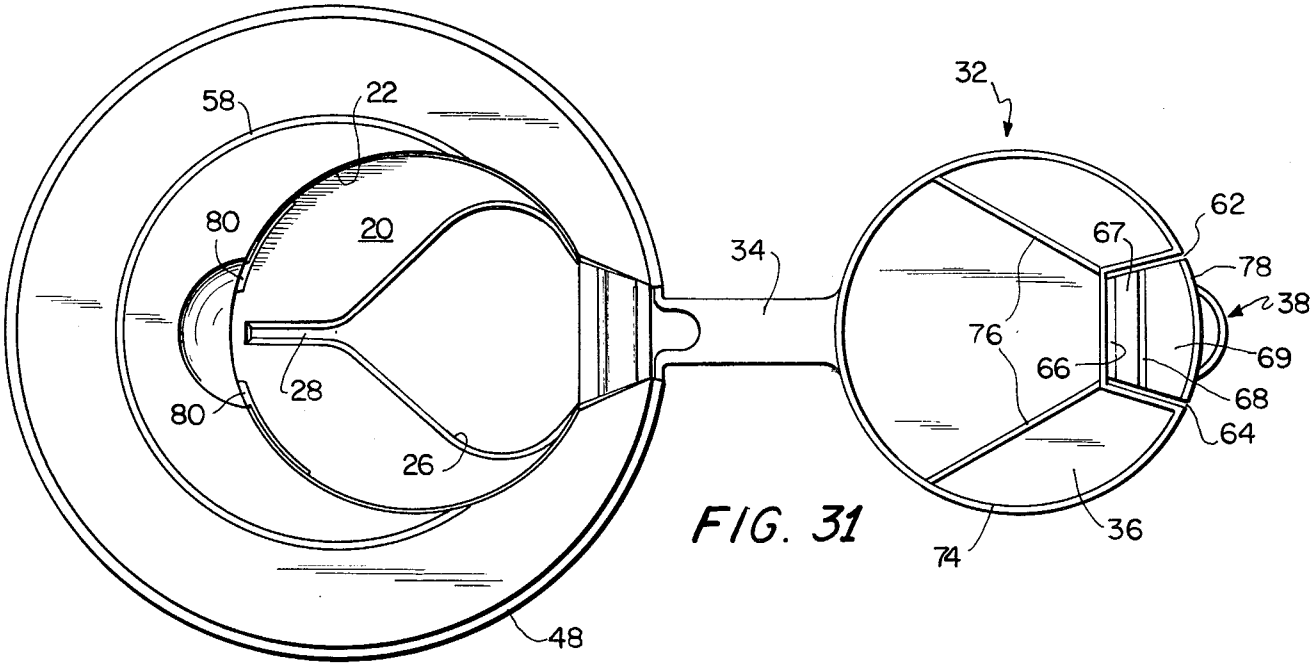
FIG. 31 is a plan view similar to FIG. 1, but illustrating certain modifications of the dispensing closure.

However, in accordance with a modified embodiment of the present invention, shown in FIG. 31, lid 32 may have therein a pair of slits 62 and 64 extending from respective first ends of the periphery of the lid to respective second ends spaced inwardly from such periphery. The pair of slits 62 and 64 converge from the first outer ends thereof to the second inner ends thereof. That portion of the lid 32 which is between the pair of slits 62 and 64 comprises the second portion 38 of the lid. The second portion 38 is integrally connected to the first portion 36 of the lid by a reduced thickness portion 66 extending between the second inner ends of the pair of slits 62 and 64.

To further increase the flexibility of second portion 38 of the lid, in both of the embodiments of FIGS. 1 and 31, the second portion 38 may have formed in the inner surface thereof a second additional reduced thickness portion 68 (shown in the embodiment of FIG. 31 only for the purpose of clarity) which extends substantially parallel to reduced thickness portion 66.

In accordance with the present invention, the recess and the lid 32 are provided with locking means for selectively removably locking the lid 32 within the recess.

When the second portion of the lid has therein two reduced thickness portions, shown only in the embodiment of FIG. 31 of the drawings for purposes of simplicity of illustration, then the reduced thickness portions 66 and 68 and the above mentioned locking means have dimensions and flexibility such that, when the lid 32 is in the first or closed position thereof, manual pressure on second reduced thickness portion 68 will automatically cause pivoting of second portion 38 with respect to first portion 36, outwardly of the recess, while the first portion 36 of the lid will remain locked in the recess by the above discussed locking means. Specifically, manual depression on second reduced thickness portion 68 will cause the area 67 between reduced portions 66 and 68 to depress, thereby causing part 69 of second portion 38 which is outward of reduced thickness portion 68 to tip or raise up out of the recess, and thus causing the entire second portion 38 to pivot with respect to the first portion 36 outwardly of the recess, while first portion 36 remains locked in the recess. This feature of the present invention is operable both with the embodiment of FIG. 31 wherein reduced thickness portions 66 and 68 are limited by the converging slits 62 and 64 and also with an embodiment wherein both reduced thickness portions extend entirely across the lid, e.g. in the form of chords.

In accordance with a specifically preferred arrangement of the present invention, the locking means includes a substantially annular bead 70 formed in the side wall 22 of the recess (see FIG. 3) and a complementary substantially annular groove 72 (see FIG. 2) formed in the lid 32. Alternatively, the annular bead 70 could be formed on the lid 32, and the groove 72 could be provided in the wall 22 of the recess.

In accordance with a further feature of the present invention, first portion 36 of the lid 32 includes an integral peripheral flange 74 which is dimensioned to press against bottom wall 20 when the lid is in the first or closed position thereof, as shown in FIGS. 4, 5, and 30. Further, first portion 36 of lid 32 may include integral projections 76, FIGS. 1 and 31, positioned to extend on opposite sides of tear-out member 24 and dispensing opening 26 when lid 32 is in the first or closed position thereof.

Also, the second portion 38 of the lid includes an annular flange portion 78 adapted to press against bottom wall 20 when the lid 32 is in the first or closed position thereof, as shown in FIG. 4 of the drawings. Alternatively, the bottom wall 20 or side wall 22 may be provided with peripheral rests 80 (FIG. 31) against which flange portion 78 of second portion 38 of the lid abuts when the lid 32 is in the first or closed position thereof.

Even further, the top 12 and side wall 22 of the recess may have formed therein an indented area 82 at a position adjacent an edge of the lid when the lid 32 is in the first or closed position thereof. Similarly, the lid 32 may have extending outwardly therefrom a tab 84 adapted to extend into indented area 82. The provision of these features facilitates manual movement of the lid 32 from the first closed position thereof to the second open position thereof, and also facilitates manual movement of the second portion 38 with respect to first portion 36, outwardly of the recess, while first portion 36 remains locked in the recess.

Figure 6:
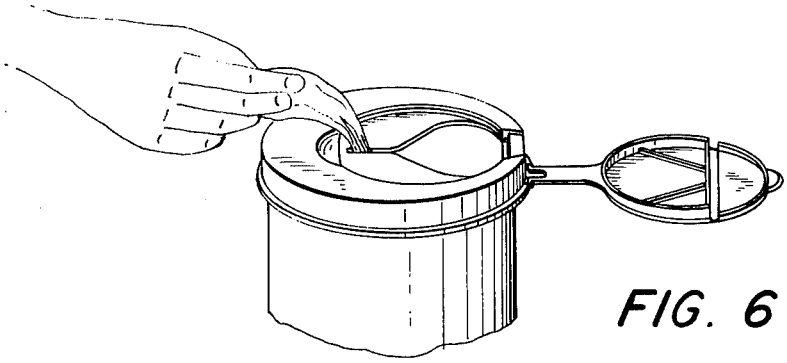
FIGS. 6 and 7 are schematic perspective views illustrating the manner of dispensing towels through the dispensing closure of FIG. 1, in various operating positions thereof.
Figure 7:
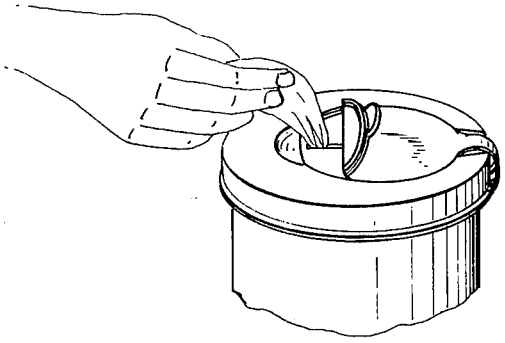

By the above described structural arrangements of the present invention, the dispensing closure 10 of the present invention may be operated so that towels may be dispensed with the lid 32 in the completely open position shown schematically in FIG. 6. Alternatively, the first portion 36 of the lid may be placed in the closed position thereof, and the second portion 38 of the lid may be pivoted out of the recess to the position shown by the dashed lines in FIG. 5, thereby uncovering only the slit 28. This still enables the towels to be dispensed through the slit 28, even when the dispensing opening 26 is closed, as schematically shown in FIG. 7 of the drawings.

Therefore, in accordance with the present invention the main dispensing opening 26 may be formed of a relatively large size to facilitate ready manual access therethrough, while such dispensing opening 26 may be closed even during the towel dispensing operation.

Figure 32:
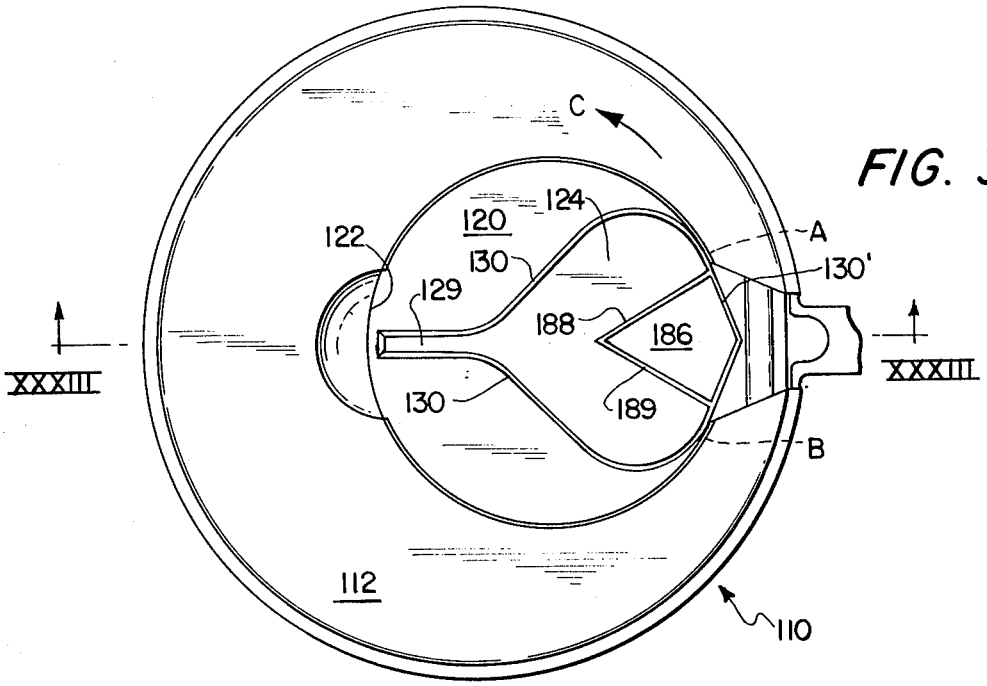
FIG. 32 is a partial plan view illustrating a further modification of the closure of the present invention.
Figure 33:
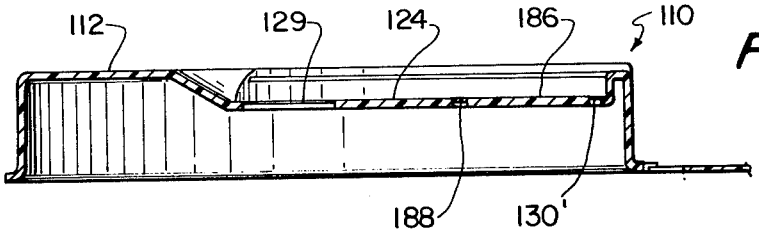
FIG. 33 is a cross-sectional view taken along line XXXIII—XXXIII of FIG. 32.

With reference now to FIGS. 32 and 33, a further embodiment of the present invention will be described. This embodiment differs from the embodiments of FIGS. 1–5, 30 and 31 in various respects. Specifically, in the above arrangements, the tear-out member had integrally formed therewith a flexible tap 42 in the configuration of a ring. In accordance with the embodiment of FIGS. 32 and 33, tab 42 is eliminated, and rather the tear-out member 124 is integrally but removably formed with the bottom wall 120 along a first reduced thickness area 130,130'. The tear-out member includes a starter portion 186 formed integrally with the remainder of the tear-out member 124 along a second reduced thickness area 188,189. A part of the perimeter or periphery of the starter portion 186 is defined by a part 130' of the first reduced thickness area. As shown in FIG. 33, the tear-out member 124 extends in the same plane as the bottom wall 120, and this is different from the arrangement of the previous embodiments as shown particularly in FIGS. 3, 4 and 30.

As shown in FIGS. 32 and 33, the second reduced thickness area includes a first part 189 having a first thickness and a second part 188 having a second thickness greater than the first thickness. One practical example would be for reduced thickness part 189 to have a thickness of 0.005 inches, and for reduced thickness part 188 to have a larger thickness of 0.015 inches. At any rate, the relative thicknesses of the two parts 189 and 188 are such that downward pressure on starter portion 186 will rupture first part 189 of the second reduced thickness area and the part 130' of the first reduced thickness area and cause the starter portion 186 to pivot downwardly about the second part 188 of the second reduced thickness area. Thereby, the starter portion 186 may then be gripped and pulled upwardly to achieve removal of the remainder of the tear-out member 124 along the remainder of the first reduced thickness area 130. Specifically, due to the pivoting of the starter portion 186 about second part 188, when the starter portion is pulled upwardly, there will be a tendency for the tear-out member 124 to be pulled in the direction of the arrow C shown in FIG. 32.

To facilitate the above operation, and specifically rupture of the part 130' of the first reduced thickness area, part 130' may be formed of the same thickness as is part 189 of the second reduced thickness area, i.e., less than the thickness of part 188 and the remainder of the first reduced thickness area 130. Even further, portions of the remainder of the first reduced thickness area 130 adjacent the parts 189 and 188 may be formed of the first thickness, i.e., the lesser thickness. Thus, that area of the remainder of the first reduced thickness area 130 adjacent the part 188, denoted by reference letter A, may be formed of the first thickness. This will facilitate the starting of the rupture of the remainder of the first reduced thickness area 130 upon upward pulling of the starter portion 186 which is pivoting around part 188. Similarly, that area of the remainder of the first reduced thickness area 130 adjacent the part 189 may similarly be formed of the smaller thickness, as denoted by reference letter B. Also, the slit, prior to removal of the tear-out member 124, may be closed, either by an extension of the tear-out member 124, or by an integral thin membrane 129 which is of the first or smaller thickness. The above discussed relative thicknesses of the reduced thickness areas are somewhat shown in the cross-section of FIG. 33 wherein the part 130' and membrane 129 are shown as being thinner than second part 188.

It will of course be understood that the starter portion 186 is of a sufficient size to enable a consumer's finger to grip the starter portion 186 after the rupture of parts 189 and 130', so that starter portion 186 may be pulled upwardly. Further, it will be apparent that starter portion 186 need not be formed in the specific configuration shown in FIG. 32, but rather may be of any other convenient configuration, for example, semi-circular, etc.

Figure 34:
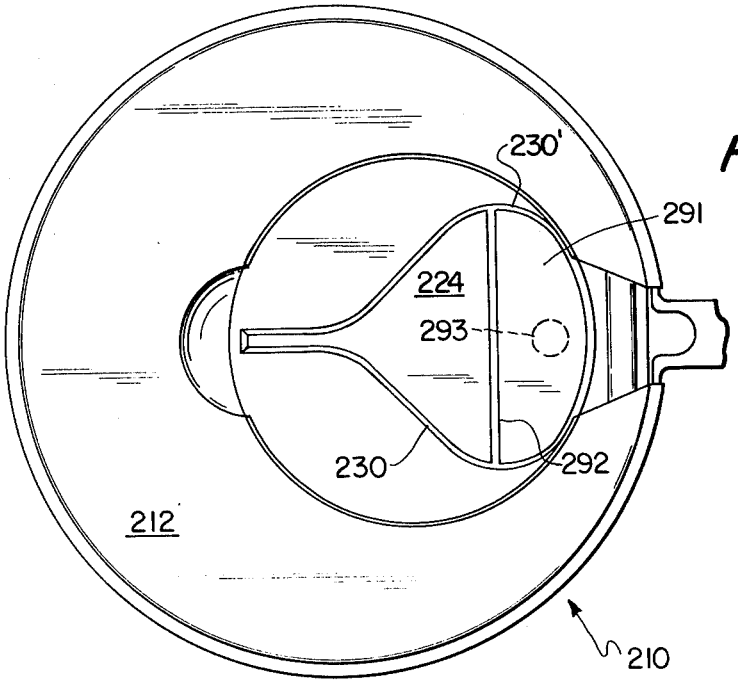
FIG. 34 is a view similar to FIG. 32, but of an even further modification of the dispensing closure of the present invention.

With reference now to FIG. 34 of the drawings, a further modification which is somewhat similar to the modification of FIG. 32 will be described. In this modification, the tear-out member 224 is also integrally but removably formed with the bottom wall along a first reduced thickness area 230,230'. The tear-out member 224 includes a starter portion 291 formed integrally with the reminder of the tear-out member 224 along a second reduced thickness area 292. A part of the periphery of the starter portion 291 is defined by a part 230' of the first reduced thickness area. In the embodiment of FIG. 34, the tear-out member 224 also extends in the same plane as the bottom wall. In the arrangement of FIG. 34 however, the second reduced thickness area 292 extends between spaced portions of the first reduced thickness area 230, such that downward pressure, for example, at spot 293, on the starter portion 291 will rupture the part 230' of the first reduced thickness area and cause the starter portion 291 to pivot downwardly about the second reduced thickness 292. Thereby, the starter portion 291 may then be gripped and pulled upwardly to achieve removal of the reminder of the tear-out member 224 along the remainder of the first reduced thickness area 230. Preferably, the second reduced thickness area 292 extends linearly between the spaced portions of the first reduced thickness area 230, as shown in FIG. 34. However, other configurations of second reduced thickness area 292 are possible. In a preferred arrangement of the present invention, the entire first reduced thickness area 230,230' is of a uniform thickness throughout the entire periphery of the tear-out member 224, including the starter portion 291. However, alternatively, part 230' of the first reduced thickness area may be of a thinner thickness than the remainder 230 of the first reduced thickness area. Also, prior to the removal of the tear-out member 224, the slit may be closed, either by an extension of the tear-out member, or by an integral thin membrane which is of the same thickness as or thinner thickness than the first reduced thickness area 230.

Figure 35:
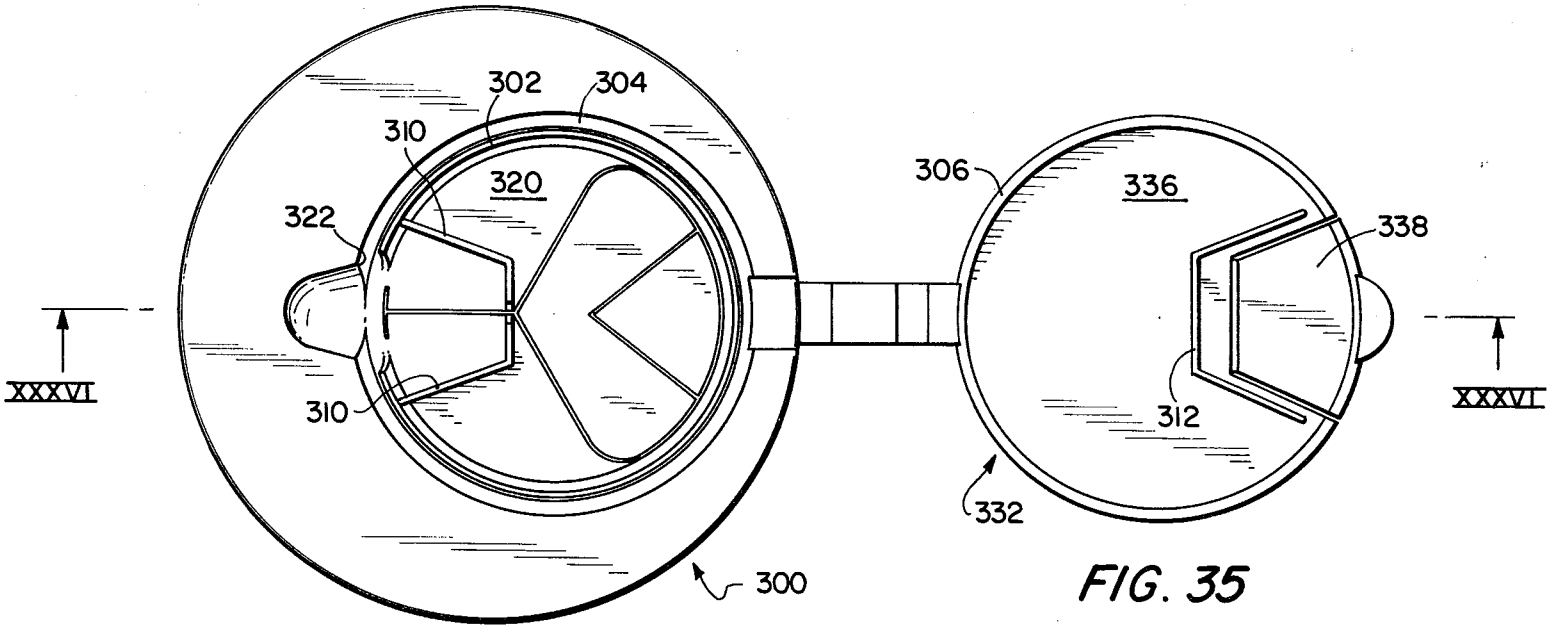
FIG. 35 is a plan view similar to FIG. 1, but illustrating further modifications of the closure of the present invention.
Figure 36:
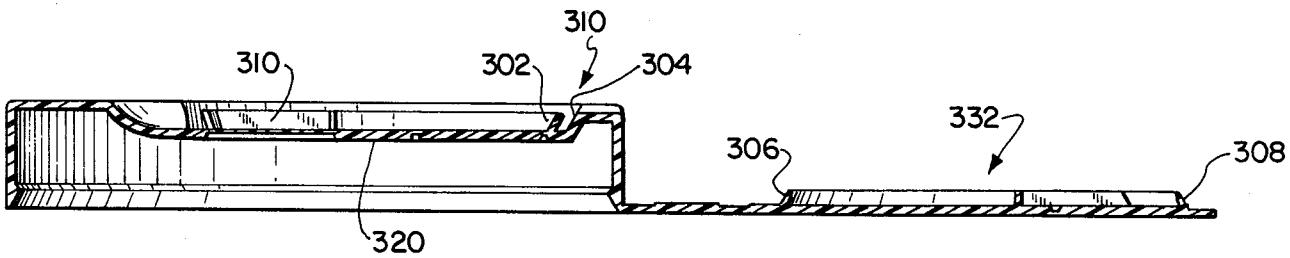
FIG. 36 is a cross-sectional view taken along line XXXVI—XXXVI of FIG. 35.

With reference now to FIGS. 35 and 36, certain additional modifications of the dispensing disclosure will be described. FIGS. 35 and 36 specifically illustrate a modification of the type of tear-out member structure shown in FIGS. 32 and 33. However, it is to be understood that the specific additional structural modifications discussed with regard to FIGS. 35 and 36 may be employed in any of the above discussed embodiments and arrangements of the present invention, either provided with a tear-out member, or originally provided without a tear-out member.

Thus, the dispensing closure 300 illustrated in FIGS. 35 and 36 is generally similar to the arrangements shown in FIGS. 32 and 33, with the following exceptions.

A first exception is the manner of locking the lid 332 in the recess. Thus, in this embodiment of the present invention, the bottom wall 320 has extending therefrom a substantially annular projection 302. Projection 302 extends at a position spaced inwardly of side wall 322 to define therewith a substantially annular groove 304. First portion 336 and second portion 338 of the lid have extending therefrom peripheral flange portions 306, 308, respectively. Flange portions 306, 308 have configurations and dimensions such as to snap into annular groove 304 when the lid is in the first position, thereby removably locking the lid in the recess. In the illustrated arrangement, projection 302 and flange portions 306, 308 have generally complementary inclined surfaces to achieve such locking. However, any other conventional expedient as will be apparent to those skilled in the art may be employed.

A second exception involves a manner of sealing the dispensing opening during a dispensing operation. Thus, as shown in FIGS. 35 and 36 bottom wall 320 has extending upwardly therefrom a pair of integral angular projections 310, for example substantially L-shaped projections. Angular projections 310 are positioned on opposite sides of the slit, and adjacent ends of the angular projections 310 are separated by the slit and by a groove or space in the area of the juncture of the slit with the dispensing opening, or the tear-out member. First portion 336 of the lid has extending therefrom a projection 312 of angular configuration dimensioned to contact angular projections 310 when the first portion 336 of the lid is in the first or closed position thereof. Thereby when the first portion of the lid is in the closed position, and when the second portion of the lid is pivoted away from the top during a dispensing opening, the contact between projection 312 and projections 310 forms a seal, thereby sealing the dispensing opening from the exterior.

Figure 37:
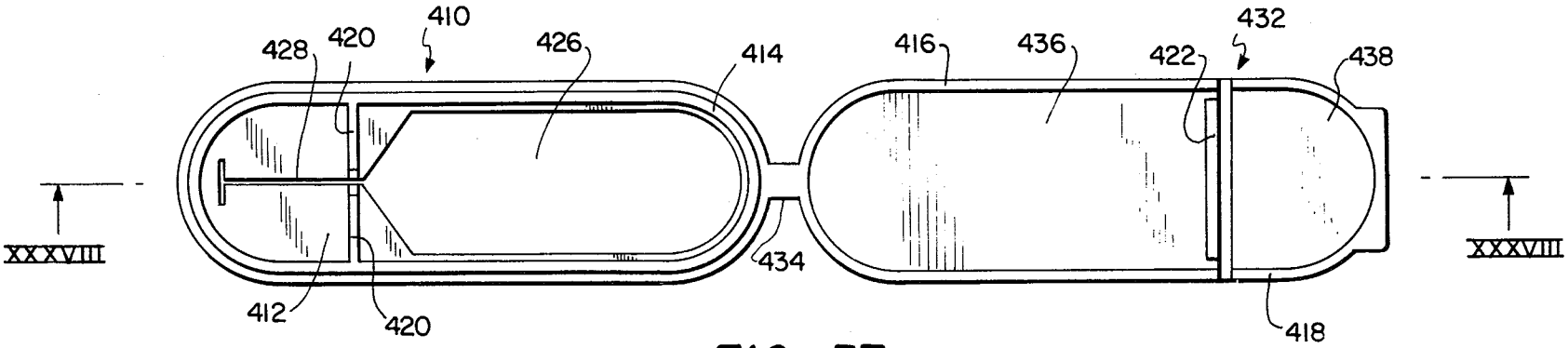
FIG. 37 is a plan view of a further arrangement of the dispensing closure of the present invention.
Figure 38:
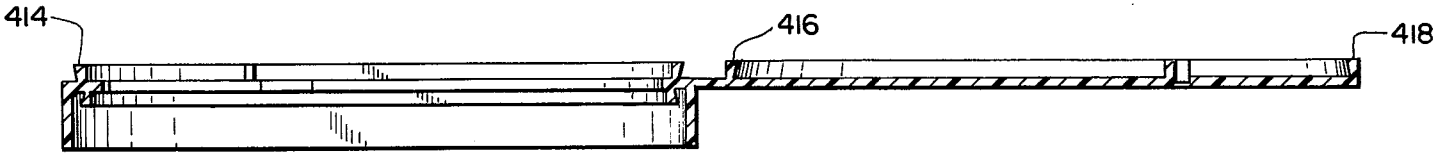
FIG. 38 is a cross-sectional view taken along line XXXVIII—XXXVIII of FIG. 37.

With reference now to FIGS. 37 and 38, a further arrangement of the dispensing closure of the present invention will be described. This arrangement is particularly suitable for a smaller size dispensing closure, for example a pocket or purse size dispenser. This embodiment does not include a recess in the top as is the case in the above arrangements. Rather, dispensing closure 410 is elongated and includes a top 412 having dispensing opening 426 and slit 428 formed directly therein. This arrangement of the invention may be originally provided with the dispensing opening. Alternatively, this arrangement could be provided with a tear-out member which is removable to form the dispensing opening. Top 412 has extending therefrom a projection 414 adjacent the periphery of the top and enclosing the dispensing opening and slit. The lid 432 includes a first portion 436 and a second portion 438. Both portions 436, 438 have extending therefrom peripheral flange portions 416, 418 which are dimensioned to snap over projection 414, thereby removably locking the lid 432 on top 412. The manner of achieving this locking is, in the illustrated embodiment, achieved by complementary inclined surfaces. Other known expedients could be employed. The lid 432 is hinged to the top 412, for example by a short strap 434. However, the lid could be hinged directly to the top, for example by a flexible reduced portion. Also, the strap 434, if employed, could be made as long as necessary and desired.

Top 412 further has depending from the underside thereof an outer axial flange and an inner axial flange dimensioned to connect the top to a dispensing container. It is however to be understood that any other attachment means discussed in the embodiments above, or other attachment methods as will be apparent to those skilled in the art may be employed.

Top 412 has extending from the upper side thereof a pair of projections, for example transverse projections 420 which are integrally formed. Projections 420 are positioned on opposite sides of slit 428, and opposed ends of projections 420 are separated from each other by a groove or a space at the area of the junction of slit 428 and dispensing opening 426. First portion 436 of the lid has extending therefrom a transverse projection 422 at a location adjacent the second lid portion. Projection 422 is located and dimensioned to contact tranverse projections 420 when the first portion 436 is in the first or closed position thereof, and thus to form a seal. Therefore, when the first lid portion 436 is in the closed position, and when the second lid portion 438 is pivoted away from the top during a dispensing operation, contact of projection 422 with projections 420 creates a seal, thereby isolating dispensing opening 426 from the exterior.

Figure 39:
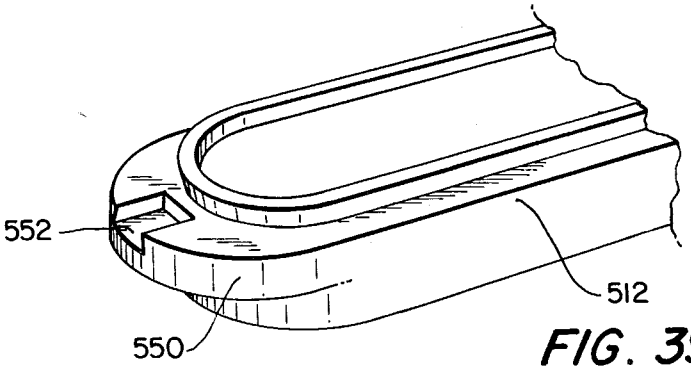
FIG. 39 is a partial perspective view of a modification of the dispensing closure of FIGS. 37 and 38.
Figure 41:
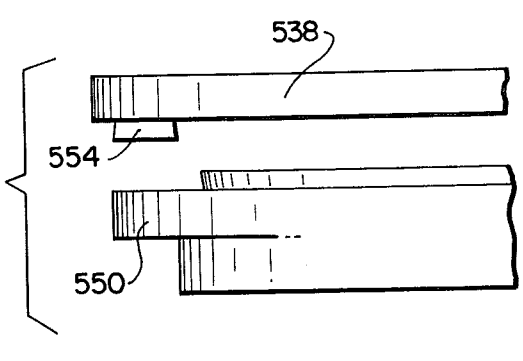
FIG. 41 is a side elevation view, taken from the right side of FIG. 40.
Figure 40:
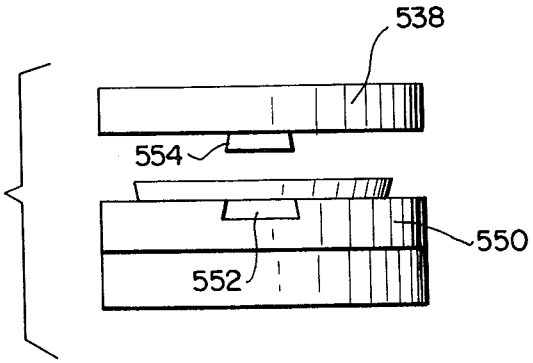
FIG. 40 is a front elevation view of the dispensing closure of FIG. 39, illustrating the lid prior to locking over the top.

FIGS. 39 through 41 illustrate an additional feature which may be employed in the arrangement of FIGS. 37 and 38. Thus, the forward end of top 512 may have extending therefrom a projection 550 having formed in the upper surface thereof an upwardly and forwardly open slot 552. Second portion 538 of the lid may have depending therefrom a tab 554 located and dimensioned to snap into slot 552 when the second portion 538 is in the closed position, thereby additionally locking the entire lid in the closed first position. In the illustrated arrangement, slot 552 is wider at the bottom thereof than at the top thereof, and tan 554 is wider at the outer portion thereof than the inner portion thereof, to achieve such snapping and locking. It will be understood however that other arrangements could be provided to achieve such locking.

The present invention has been described and illustrated with respect to specific preferred stuctural arrangements thereof. However, it is to be understood that various modifications may be made to the specifically described and illustrated structural arrangements without departing from the scope of the present invention. It specifically is to be understood that the circular arrangements shown in FIGS. 1 through 7 and 30 through 36 and the elongated structural arrangement shown in FIGS. 37 through 41 are exemplary only and not limiting of the present invention, since other configurations of the closure and/or lid may be employed within the scope of the present invention.

It is to be understood that the present invention is not intended to be limited to the particular type or form of towel package, but rather that the invention may be employed to dispense many various known forms of towel packages, such as towels which are joined by folding or interleafing or towels which are in the form of a continuous web wherein individual towels are separable along perforations, such web being packaged in the canister in various different forms, such as a roll, a folded arrangement, a random arrangement, etc. The above examples are however not intended to be limiting to the scope of the present invention.

I claim:

1. A package comprising:

a canister having an open end and containing a web of towels which are separably connected by perforations; and a dispensing closure for closing said open end of said canister and for dispensing therefrom said towels individually, said closure comprising:

a top fitting over said open end of said canister, said top having depending therefrom an integral peripheral axial flange fitting and positioning said top on said canister;

said top having therein a dispensing opening and a slit connected with said dispensing opening;

a lid selectively movable between a first position covering at least a portion of said top and a second position removed from said top;

said lid including a first portion adapted to cover said dispensing opening when said lid is in said first position thereof, said lid including a second portion adapted to cover said slit when said lid is in said first position thereof, and said second portion of said lid being integrally but flexibly connected to said first portion of said lid, such that when said lid is in said first position thereof said second portion of said lid is selectively pivotable with respect to said first portion of said lid away from said top thereby to uncover said slit; and said dispensing opening having a size sufficient to enable fingers of a consumer to extend through said dispensing opening to grasp a first towel of said web of towels and to then pull such first towel toward and into said slit, and said slit having a size and shape such that, upon pulling a towel outwardly of said canister through said slit, side edges of said slit apply sufficient tension on the towel being pulled through the slit to allow separation of such towel from a succeeding towel of said web of towels, whereby such succeeding towel will then be partially extended through said slit.

2. A package as claimed in claim 1, wherein a portion of said top is defined by an integral tear-out member, such that removal of said tear-out member forms said dispensing opening.

3. A package as claimed in claim 1, wherein said top has therein a recess defined by a bottom wall and a side wall joining said bottom wall to said top, said dispensing opening and said slit are in said bottom wall, and said lid fits into said recess when in said first position.

4. A package as claimed in claim 3, wherein a portion of said bottom wall is defined by an integral tear-out member, such that removal of said tear-out member forms said dispensing opening in said bottom wall.

5. A package as claimed in claims 2 or 4, wherein said entire closure, including said top, said flange, said tear-out member and said first and second portions of said lid are formed of an integral single member.

6. A package as claimed in claim 5, wherein said integral single member comprises a molded plastic element.

7. A package as claimed in claims 2 or 4, wherein said tear-out member is integrally but removably formed along reduced thickness score lines.

8. A package as claimed in claim 2, wherein said tear-out member is integrally but removably formed with said top in a plane extending beneath the plane of said top.

9. A package as claimed in claim 4, wherein said tear-out member is integrally but removably formed with said bottom wall in a plane extending beneath the plane of said bottom wall.

10. A package as claimed in claims 2 or 4, further comprising a flexible tab integrally formed with said tear-out member and extending outwardly therefrom to facilitate removal of said tear-out member, said tab having a size to fit between said tear-out member and said first portion of said lid when said lid is in said first position thereof.

11. A package as claimed in claim 10, wherein said tab is ring-shaped.

12. A package as claimed in claims 2 or 4, wherein, prior to removal of said tear-out member, said slit is closed by an integral extension of said tear-out member.

13. A package as claimed in claims 2 or 4, wherein, prior to removal of said tear-out member, said slit is closed by an integral thin membrane which is readily rupturable after removal of said tear-out member.

14. A package as claimed in claims 2 or 4, wherein said tear-out member has a configuration such that upon removal of said tear-out member said dispensing opening will include edges converging toward and joining side edges of said slit.

15. A package as claimed in claim 14, wherein said dispensing opening has a substantially teardrop-shaped configuration.

16. A package as claimed in claim 1, wherein said slit has a first end opening into said dispensing opening and a second end spaced from said dispensing opening.

17. A package as claimed in claim 16, wherein said slit is in the shape of a straight line from said first end to said second end.

18. A package as claimed in claim 16, further comprising a conically tapered hole connected to said second end of said slit.

19. A package as claimed in claim 16, further comprising an integral bead extending transversely across said second end of said slit.

20. A package as claimed in claim 16, wherein said slit is formed by side edges converging from said first end to a point at said second end.

21. A package as claimed in claim 16, wherein said second end of said slit is L-shaped.

22. A package as claimed in claim 16, wherein said second end of said slit is T-shaped.

23. A package as claimed in claim 16, wherein said second end of said slit is H-shaped.

24. A package as claimed in claim 16, wherein said second end of said slit is F-shaped.

25. A package as claimed in claim 16, wherein said second end of said slit is hook-shaped.

26. A package as claimed in claim 16, wherein said second end of said slit is arrow-shaped.

27. A package as claimed in claim 16, wherein said second end of said slit is diamond-shaped.

28. A package as claimed in claim 16, wherein said second end of said slit is teardrop-shaped.

29. A package as claimed in claim 16, wherein said second end of said slit has a double-diamond configuration.

30. A package as claimed in claim 16, wherein said second end of said slit extends at an angle inclined with respect to the remainder of said slit.

31. A package as claimed in claim 16, wherein said second end of said slit is shaped like a cross with two cross bars.

32. A package as claimed in claim 1, wherein said axial flange has a free axial end including a radially outwardly extending annular flange.

33. A package as claimed in claim 1, wherein said axial flange includes an integral radially inwardly extending annular bead cooperating with an outer annular bead on said canister to attach said closure to said canister.

34. A package as claimed in claim 1, wherein said axial flange includes an integral radially inwardly extending annular projection forming a lip cooperating with an outer annular lip on said canister to attach said closure to said canister, and wherein said top has depending therefrom an axially extending annular bead, at a position coaxially inwardly of said axial flange, cooperating with an inner surface of said canister to form a leakproof seal therewith.

35. A package as claimed in claim 1, wherein said top has extending outwardly therefrom an integral stacking rib to facilitate stacking of plural canisters, each equipped with a said closure.

36. A package as claimed in claim 17, further comprising a flexible connecting hinge integral with said lid and said axial flange and connecting said lid to said axial flange.

37. A package as claimed in claim 36, wherein said top has therein a recessed groove portion at a position such that when said lid is in said first position thereof said hinge fits into and is accommodated within said recessed groove portion.

38. A package as claimed in claim 1, wherein said second portion of said lid is integrally connected to said first portion of said lid by a reduced thickness portion of said lid, said reduced thickness portion being in the form of a chord, such that said first and second portions of said lid are in the form of segments.

39. A package as claimed in claim 1, wherein said lid has therein a pair of slits extending from respective first ends at the periphery of said lid to respective second ends spaced inwardly from said periphery, said pair of slits converging from said first ends to said second ends, that part of said lid between said pair of slits comprising said second portion of said lid, and wherein said second portion of said lid is integrally connected to said first portion of said lid by a reduced thickness portion extending between said second ends of said pair of slits.

40. A package as claimed in claim 3, further comprising means for selectively removably locking said lid within said recess.

41. A package as claimed in claim 40, wherein said locking means comprises a substantially annular bead in one of said side wall of said recess and said lid and a complementary substantially annular groove in the other of said lid and said side wall.

42. A package as claimed in claim 3, wherein said second portion of said lid is integrally connected to said first portion of said lid by a first reduced thickness portion of said lid, and further comprising a second reduced thickness portion of said second portion of said lid, said second reduced thickness portion extending substantially parallel to said first reduced thickness portion, said reduced thickness portions having dimensions and flexibility such that, when said lid is in said first position thereof, manual pressure on said second reduced thickness portion will pivot said second portion of said lid with respect to said first portion of said lid outwardly of said recess, while said first portion of said lid remains in said recess.

43. A package as claimed in claim 3, wherein said first portion of said lid includes an integral peripheral flange extending therefrom, said peripheral flange being dimensioned to press against said bottom wall when said lid is in said first position thereof.

44. A package as claimed in claim 43, wherein said first portion of said lid further includes integral projections extending therefrom, said projections being positioned to extend on opposite sides of said dispensing opening when said lid is in said first position thereof.

45. A package as claimed in claim 3, wherein said recess has therein peripheral rests, and said second portion of said lid includes an integral flange portion abutting against said rests when said lid is in said first position thereof.

46. A package as claimed in claim 3, wherein said top and said side wall of said recess have therein an indented area at a position adjacent an edge of said lid when said lid is in said first position thereof.

47. A package as claimed in claim 46, wherein said second portion of said lid includes an integral tab extending outwardly therefrom and fitting into said indented area when said lid is in said first position thereof.

48. A package as claimed in claim 3, wherein said lid has therein a pair of slits extending from respective first ends at the periphery of said lid to respective second ends spaced inwardly from said periphery, said pair of slits converging from said first ends to said second ends, that part of said lid between said pair of slits comprising said second portion of said lid, and wherein said second portion of said lid is integrally connected to said first portion of said lid by a first reduced thickness portion extending between said second ends of said pair of slits, and further comprising a second reduced thickness portion of said second portion of said lid, said second reduced thickness portion extending substantially parallel to said first reduced thickness portion, said reduced thickness portions having dimensions and flexibility such that, when said lid is in said first position thereof, manual pressure on said second reduced thickness portion will pivot said second portion of said lid with respect to said first portion of said lid outwardly of said recess, while said first portion of said lid remains in said recess.

49. A package as claimed in claim 4, wherein said tear-out member is integrally but removably formed with said bottom wall along a first reduced thickness area, said tear-out member includes a starter portion formed integrally with the remainder of said tear-out member along a second reduced thickness area, and a part of the periphery of said starter portion being defined by a part of said first reduced thickness area.

50. A package as claimed in claim 49, wherein said tear-out member extends in the same plane as said bottom wall.

51. A package as claimed in claim 49, wherein said second reduced thickness area extends between spaced portions of said first reduced thickness area, such that downward pressure on said starter portion will rupture said part of said first reduced thickness area and cause said starter portion to pivot downwardly about said second reduced thickness area, whereby said starter portion may then be gripped and pulled upwardly to achieve removal of said remainder of said tear-out member along the remainder of said first reduced thickness area.

52. A package as claimed in claim 51, wherein said second reduced thickness area extends linearly between said spaced portions of said first reduced thickness area.

53. A package as claimed in claim 51, wherein said part of said first reduced thickness area is of a first thickness, and said remainder of said first reduced thickness area is of a second thickness greater than said first thickness.

54. A package as claimed in claim 51, wherein said first reduced thickness area is of a uniform thickness throughout the entire periphery of said tear-out member.

55. A package as claimed in claim 54, wherein, prior to removal of said tear-out member, said slit is closed by an integral thin membrane which is of the same thickness as said first reduced thickness area.

56. A package as claimed in claim 51, wherein said second reduced thickness area includes a first part having a first thickness and second part having a second thickness greater than said first thickness, whereby downward pressure on said starter portion will rupture said first part of said second reduced thickness area and said part of said first reduced thickness area and cause said starter portion to pivot downwardly about said second part of said second reduced thickness area, whereby said starter portion may then be gripped and pulled upwardly to achieve removal of said remainder of said tear-out member along the remainder of said first reduced thickness area.

57. A package as claimed in claim 56, wherein said part of said first reduced thickness area is of said first thickness.

58. A package as claimed in claim 57, wherein a first portion of said remainder of said first reduced thickness area adjacent at least said second part of said second reduced thickness area is of said first thickness, and a second portion of said remainder of said first reduced thickness area is of said second thickness.

59. A package as claimed in claim 57, wherein first portions of said remainder of said first reduced thickness area adjacent said first and second parts of said second reduced thickness area are of said first thickness, and a second portion of said remainder of said first reduced thickness area is of said second thickness.

60. A package as claimed in claim 57, wherein, prior to removal of said tear-out member, said slit is closed by an integral thin membrane which is of said first thickness.

61. A package as claimed in claim 3, further comprising a substantially annular projection extending from said bottom wall at a position spaced inwardly of said side wall to define therewith a substantially annular groove, and peripheral flange portions extending from said first and second portions of said lid, said peripheral flange portions having a configuration to snap into said annular groove when said lid is in said first position, thereby removably locking said lid in said recess.

62. A package as claimed in claims 3 or 61, further comprising a pair of angular projections extending from said bottom wall on opposite sides of said slit, and a projection extending from said first portion of said lid and dimensioned to contact said annular projections when said first portion of said lid is in said first position, thereby forming a seal.

63. A package as claimed in claim 1, further comprising a projection extending from said top at a position adjacent the periphery thereof, and peripheral flange portions extending from said first and second portions of said lid and dimensioned to snap over said projection, thereby removably locking said lid on said top.

64. A package as claimed in claim 63, further comprising transverse projections extending from said top on opposite sides of said slit at locations adjacent said dispensing opening, and a transverse projection extending from said first portion of said lid at a location adjacent said second portion of said lid and to contact said transverse projections on said top when said first portion of said lid is in said first position, thereby forming a seal.

65. A package as claimed in claim 1, wherein a forward end of said top has a slot therein, at a position spaced from said dispensing opening, and said second portion of said lid has extending therefrom a tab dimensioned to snap into said slot, thereby removably locking said lid in said first position.

66. A package as claimed in claim 65, wherein said slot is wider at the bottom thereof than the top thereof, and said tab is wider at the outer portion thereof than the inner portion thereof.

* * * * *

UNITED STATES PATENT AND TRADEMARK OFFICE

CERTIFICATE OF CORRECTION

PATENT NO. : 4,462,507

DATED : July 31, 1984

INVENTOR(S) : Herman Margulies

It is certified that error appears in the above-identified patent and that said Letters Patent is hereby corrected as shown below:

Column 3, line 62,
"potions" should read -- portions --.

Column 16, line 41,
"tan" should read -- tab --.

Column 17, Claim 1, lines 3 and 4,
"performations" should read
-- perforations --.

Signed and Sealed this

*Twenty-sixth* Day of *March 1985*

[SEAL]

*Attest:*

DONALD J. QUIGG

*Attesting Officer*

*Acting Commissioner of Patents and Trademarks*